US008468909B2

(12) United States Patent
Hori et al.

(10) Patent No.: US 8,468,909 B2
(45) Date of Patent: Jun. 25, 2013

(54) ELECTRIC LEVER DEVICE

(75) Inventors: Shuuji Hori, Oyama (JP); Mitsumasa Akashi, Oyama (JP); Hiroyuki Chikugo, Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 13/130,236

(22) PCT Filed: Nov. 16, 2009

(86) PCT No.: PCT/JP2009/069452

§ 371 (c)(1),
(2), (4) Date: May 19, 2011

(87) PCT Pub. No.: WO2010/058758

PCT Pub. Date: May 27, 2010

(65) Prior Publication Data

US 2011/0226087 A1 Sep. 22, 2011

(30) Foreign Application Priority Data

Nov. 21, 2008 (JP) ..... 2008-298715

(51) Int. Cl.
*G05G 5/06* (2006.01)

(52) U.S. Cl.
USPC ..... 74/523

(58) Field of Classification Search
USPC ..... 74/473.1, 473.12, 473.21, 473.25, 74/473.3, 523, 527, 528, 532
See application file for complete search history.

(56) References Cited

U.S. PATENT DOCUMENTS

| | | | | |
|---|---|---|---|---|
| 1,976,309 | A * | 10/1934 | Thomson | 74/473.21 |
| 5,802,922 | A * | 9/1998 | Kawai et al. | 74/473.1 |
| 6,662,678 | B2 * | 12/2003 | Tomida | 74/523 |
| 2008/0047384 | A1 * | 2/2008 | Hattori | 74/473.3 |

FOREIGN PATENT DOCUMENTS

| | | | |
|---|---|---|---|
| CN | 200999000 | Y | 1/2008 |
| JP | 63-118621 | U | 8/1988 |
| JP | HEI4-17877 | | 4/1992 |
| JP | 6-348356 | A | 12/1994 |
| JP | 08-233076 | | 9/1996 |
| JP | 10-331995 | A | 12/1998 |
| JP | 2007-323188 | A | 12/2007 |

OTHER PUBLICATIONS

International Search Report for PCT/JP2009/069452 issued Feb. 9, 2010.

* cited by examiner

*Primary Examiner* — Vicky Johnson
(74) *Attorney, Agent, or Firm* — Edwards Wildman Palmer LLP

(57) ABSTRACT

An electric lever device includes a detent mechanism 6 between the rotational center shaft 3 and the handgrip 2. The detent mechanism 6 includes a pressing unit 10 including a through hole 11 formed in an axis C1 direction of the operation lever 1, an extension coil spring 12 inserted into the through hole 11 and balls 13*a* and 13*b* provided on both ends of the extension coil spring 12 for generating pressing force in the axis C 1 direction, and a guide unit 20 for guiding movement in a circumferential direction of the axis C 1 and changing the pressing force by changing a guide width in the axis C1 direction to apply a load to the movement of the operation lever 1 together with pulling force of a twisted coil spring 30.

7 Claims, 4 Drawing Sheets

ELECTRIC LEVER DEVICE

CROSS REFERENCE TO RELATED APPLICATIONS

This application is the national stage of International Application No. PCT/JP2009/069452, filed Nov. 16, 2009, which application claim priority to Japanese Pat. App. No. 2008-298715, filed Nov. 21, 2008, which application is incorporated herein by reference.

FIELD

The present invention relates to an electric lever device including a detent function to apply a load to an operation lever at a desired detent position to instruct an operator of a current operation state or a next operation state.

BACKGROUND

In general, an operation lever device is used in a construction machine, an industrial machine and the like for operating control of a hydraulic cylinder and control of a transmission. As the operation lever device, there is the one for outputting an operation amount of the operation lever as a mechanical displacement amount, the one for converting the operation amount of the operation lever to a hydraulic pressure to output, and the one for converting the operation amount of the operation lever to an electric signal to output.

The Patent Literature 1 discloses the one for converting the operation amount of the operation lever to the hydraulic pressure to output in which the operation lever is provided with a detent mechanism including a cum member with detent grooves formed on a plurality of working positions.

Also, the Patent Literature 2 discloses the operation lever device for converting the operation amount of the operation lever to the electric signal to output including a magnet provided on a circumference of a rotating body and a hole device for detecting a magnetic field generated by the magnet for detecting a stroke amount of the operation lever.

CITATION LIST

Patent Literature

Patent Literature 1: Japanese Patent Application Laid-open No. H10-331995

Patent Literature 2: Japanese Patent Application Laid-open No. 2007-323188

SUMMARY

Technical Problem

However, even though the conventional operation lever device includes the detent mechanism for instructing the operator of the current operation state of the operation lever, there is a problem that resolution of the detent position is low and it is not possible to instruct the operator of a sufficient detent position with a high degree of accuracy.

The present invention is achieved in view of the above description and an object thereof is to provide the electric lever device including the detent mechanism capable of instructing the operator of the detent position with the high degree of accuracy.

According to an aspect of the resent invention, an electric lever device includes: an operation lever including a handgrip held by an operator on one end and a rotational center shaft of the operation lever formed on the other end; a detecting unit for detecting a rotation amount of the rotational center shaft; and a holding unit for fixing the operation lever to prevent return. The detecting unit and the holding unit are arranged on a surface perpendicular to an attaching surface of the electric lever device and a surface perpendicular to the rotational center shaft of the operation lever. A detent mechanism is provided between the rotational center shaft and the handgrip.

Advantageously, in the electric lever device, the detent mechanism includes: a pressing mechanism provided on the operation lever for generating pressing force in an axial direction of the rotational center shaft; and a detent guide mechanism that guides a movement of the operation lever to a circumferential direction of the rotational center shaft, and changing the pressing force by changing a guide width in the axial direction of the rotational center shaft in order to apply a load to the movement of the operation lever.

Advantageously, in the electric lever device, the pressing mechanism includes: a hole formed in the axial direction of the rotational center shaft of the operation lever; an extension member extended by changing the pressing force in the axial direction of the rotational center shaft arranged in the hole; and a ball provided on an end of the extension member and is capable of moving in and out of the hole to be brought into contact with the detent guide mechanism.

Advantageously, in the electric lever device, the hole is a through hole, and the ball is provided on both ends of the extension member.

Advantageously, in the electric lever device, the detent mechanism sequentially enlarges a load applied to the operation lever at a desired detent position in the middle of the movement of the operation lever from a neutral state to a maximum operation amount state.

Advantageously, in the electric lever device, the detent mechanism applies the load to the operation lever before transition from the neutral state to a variable control state of the operation lever and applies the load to the operation lever before transition from the variable control state to the maximum operation amount state of the operation lever.

Advantageously, in the electric lever device, the detent mechanism is provided in the vicinity of the attaching surface of the electric lever device.

Advantageously, in the electric lever device, the holding unit includes an electromagnetic coil unit for holding a position of the operation lever at the maximum operation amount state by electromagnetic force.

Solution to Problem

ADVANTAGEOUS EFFECTS OF INVENTION

According to the present invention, since the detent mechanism is provided between the rotational center shaft of the operation lever and the handgrip of the operation lever, a long movement range of the detent mechanism corresponding to a movement amount of the operation lever may be obtained and the resolution of the detent position is improved, so that it is possible to instruct the operator of the detent position with the high degree of accuracy.

DESCRIPTION OF EMBODIMENTS

Hereinafter, an electric lever device being a best mode for carrying out this invention is described with reference to the drawings.

Figure 1:
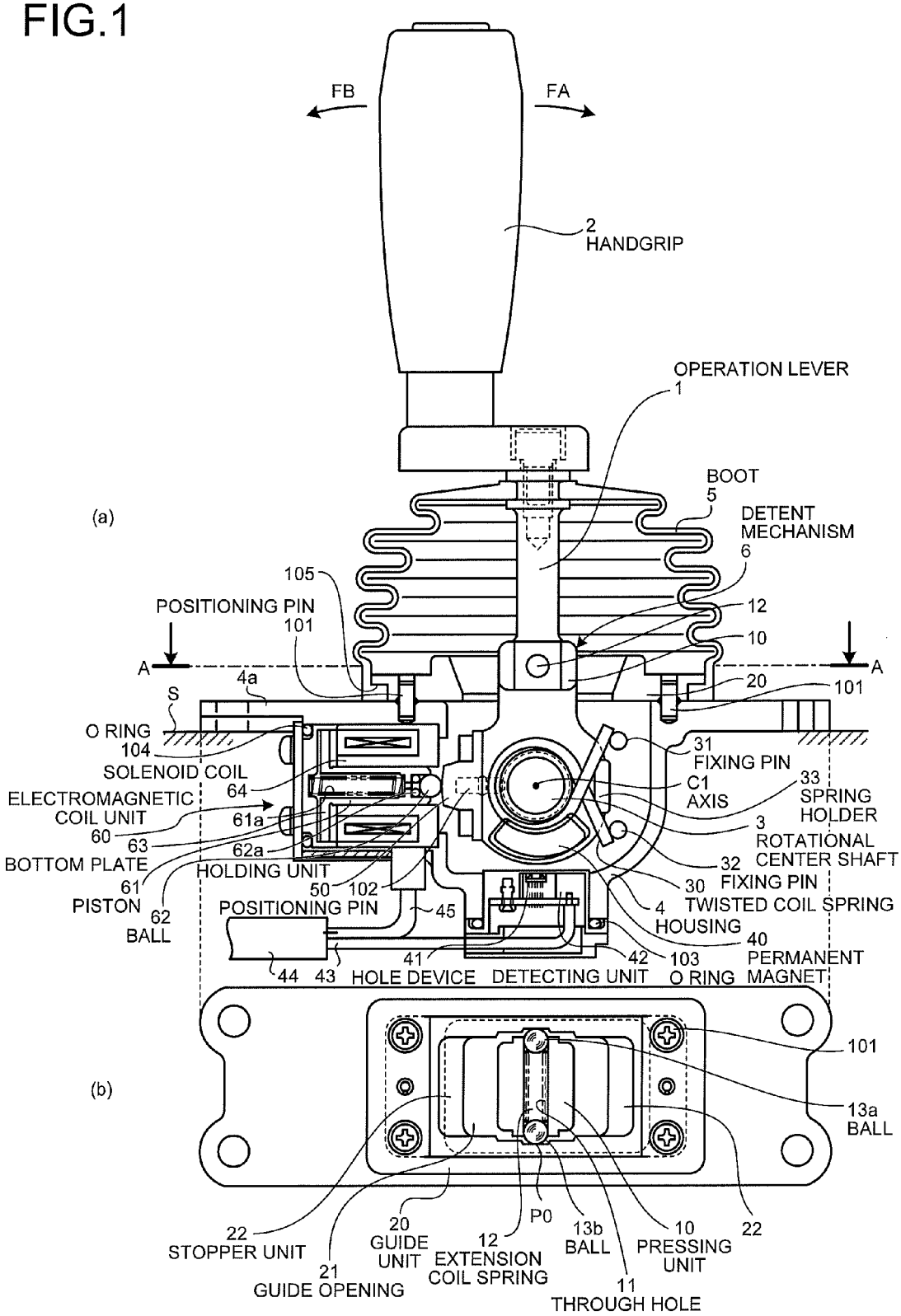
FIG. 1 is a view illustrating a configuration at a neutral position of an electric lever device being an embodiment of this invention.
Figure 2:
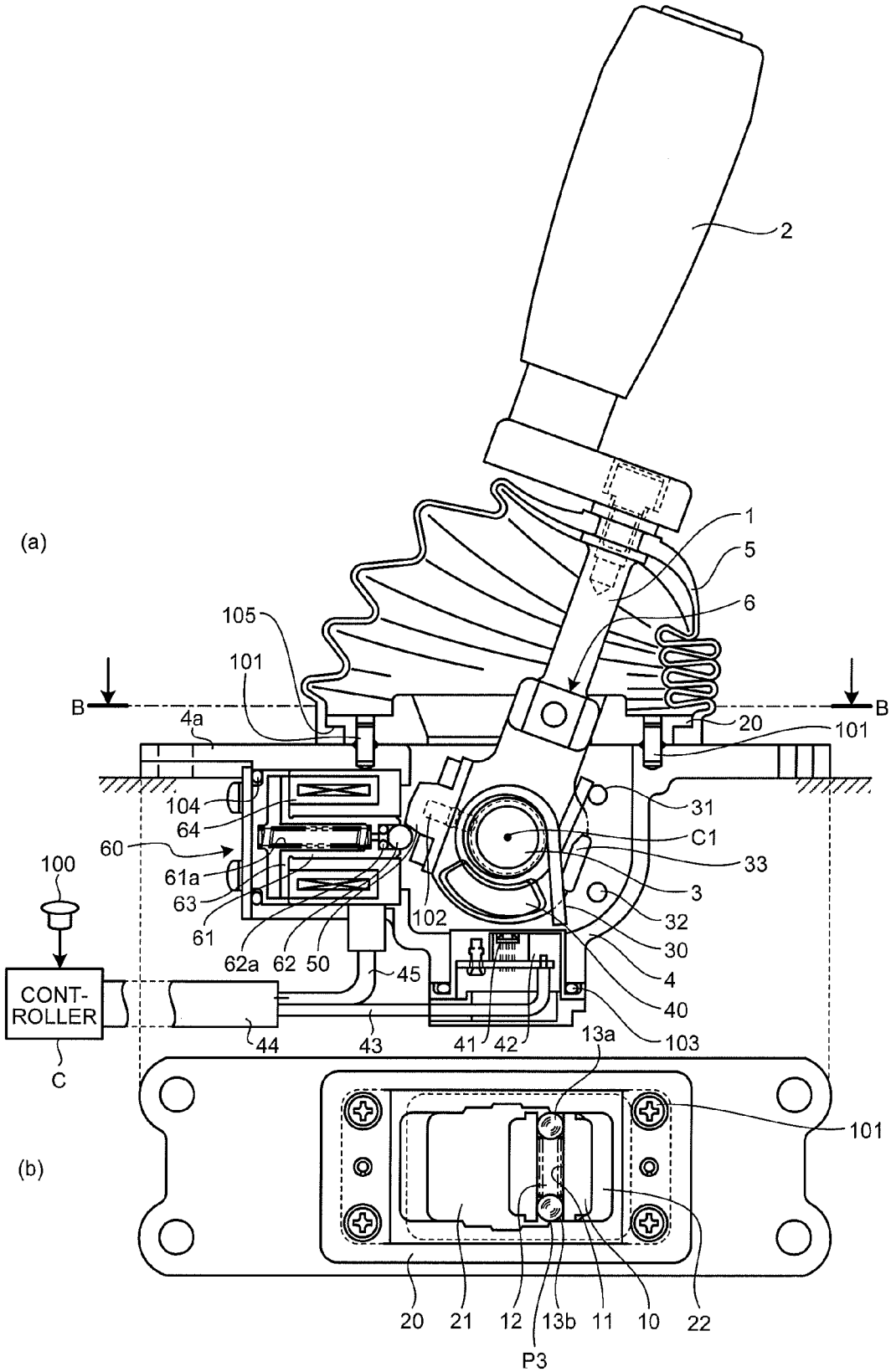
FIG. 2 is a view illustrating a configuration at a maximum operation amount position of the electric lever device being the embodiment of this invention.

FIG. 1 is a view illustrating a configuration of the electric lever device being an embodiment of this invention. FIG. 1(*a*) is a cross-sectional view of the electric lever device and FIG. 1(*b*) is a cross-sectional view taken along the line A-A in FIG. 1(*a*). Meanwhile, FIG. 1 illustrates a case in which an operation lever is at a neutral position. Also, FIG. 2 is a cross-sectional view in a case in which the operation lever of the electric lever device illustrated in FIG. 1 is at a maximum operation amount position and a cross-sectional view taken along the line B-B. The electric lever device is configured to control a direction switching valve of a hydraulic cylinder of a construction machine such as a bucket.

In FIGS. 1 and 2, the electric lever device includes an operation lever 1, which rotates around an axis C1, and a handgrip 2 held by an operator is provided on one end of the operation lever 1 and a rotational center shaft 3 is provided on the other end of the operation lever 1. The operation lever 1 may rotate in circumferential directions FA and FB around the axis C1. A detent mechanism 6 is provided between the handgrip 2 and the rotational center shaft 3 of the operation lever 1. The rotational center shaft 3 is enclosed by a housing 4 and the housing 4 is provided with a detecting unit 42 for detecting a rotation amount of the rotational center shaft 3, an electromagnetic coil unit 60 for holding the operation lever 1 at the maximum operation amount position of the operation lever 1 by electromagnetic force, and the detent mechanism 6 for applying a load to the operation lever 1 in order to instruct the operator of a desired detent position in a circumferential direction of the axis C1. Meanwhile, the rotational center shaft 3 is supported by a side wall of the housing 4.

The detent mechanism 6 includes a pressing unit 10 and a guide unit 20 and is provided in the vicinity of an attaching surface S of the construction machine and the like to which the electric lever device is attached in this embodiment. Meanwhile, the electric lever device is attached to the attaching surface S through an attaching portion 4*a* being a flange from the housing 4. The guide unit 20 is a flat plate-shaped member and includes a guide opening 21 into which the pressing unit 10 is inserted, and in the guide opening 21, a stopper unit 22 in which both end sides in a rotational direction of the operation lever 1 incline in a radial direction from the axis C1 to serve as a stopper to define the maximum operation amount is formed. Also, the guide opening 21 guides movement of the operation lever 1 and includes a step formed such that a width in the axis C1 direction becomes sequentially narrower from the neutral position P0 in the circumferential directions FA and FB.

On the other hand, the pressing unit 10 is formed so as to fit into the guide opening 21, a through hole 11 in the axis C1 direction is formed in the operation lever 1, an extension coil spring 12, which extends in the axis C1 direction, is inserted into the through hole 11, and balls 13*a* and 13*b* of bearing steel having a diameter, which fits into the through hole 11, are arranged on both ends of the extension coil spring 12. Then, the balls 13*a* and 13*b* move in and out of the through hole 11 to press a guide surface of the guide opening 21. A gap smaller than a radius of the balls 13*a* and 13*b* is provided between each of the balls 13*a* and 13*b* and the guide surface such that the balls 13*a* and 13*b* do not fall. Herein, when getting over the step of the guide opening 21, a certain load is applied to the operation lever 1 due to presence of the balls 13*a* and 13*b*. Meanwhile, the guide unit 20, especially the stopper unit 22 and the balls 13*a* and 13*b* are carburized to harden a surface layer thereof and is allowed to have abrasion resistance and toughness.

A twisted coil spring 30 for generating reaction force in the circumferential direction is fitted into an outer circumference of the rotational center shaft 3 and both ends of the coil spring 30 are prevented from rotating by fixing pins 31 and 32 arranged on a housing 4 side. A spring holder 33 is provided on an operation lever 1 side between the both ends of the coil spring 30, and the spring holder 33 moves one end side of the coil spring 30 in association with rotation of the operation lever 1 and the other end thereof is held by the fixing pin 31 or the fixing pin 32, so that the reaction force is accumulated in the coil spring 30 and this generates force to return in a direction opposite to a rotational direction of the operation lever 1. That is to say, force to return the operation lever 1 to the neutral position P0 always acts and the force to return increases as the rotation amount of the operation lever 1 increases.

Also, a permanent magnet 40 is provided on the operation lever 1 around the rotational center shaft 3, and the permanent magnet 40 moves in association with the rotation of the operation lever 1. On the other hand, on the housing 4 side, the detecting unit 42 is provided on a position corresponding to an attaching position of the permanent magnet 40 and the detecting unit 42 is provided with two hole devices 41 for detecting a magnetic field from the permanent magnet 40. The hole device 41 is fixedly arranged on the housing 4 and detects the magnetic field, which changes in association with the movement of the permanent magnet 40, thereby detecting the position of the permanent magnet 40, in other words, a rotation amount (operation amount) of the operation lever 1 from the neutral position P0. A detection result is externally output through a cable 43 and a connector 44 as an electric signal to be a control signal of a control valve and the like of the hydraulic cylinder and the like.

Further, a holding unit 50 with a convex portion formed in a radial direction is provided on a predetermined position of the operation lever around the rotational center shaft 3 for fixing the operation lever 1 in this state and preventing return thereof when the operation lever 1 reaches a maximum operation amount position P3. Also, an electromagnetic coil unit 60 including a piston 61, which engages with the convex portion of the holding unit 50, is provided on a position of the housing 4 corresponding to the holding unit 50 for removing the return of the operation lever 1 at the maximum operation amount position P3 to fix the same. The electromagnetic coil unit 60 includes a solenoid coil 64 and the piston 61, which directly operates in the radial direction of the axis C1, is provided in a bore of the solenoid coil 64. A bottom plate 63, which covers a side portion in a radial outward direction of the solenoid coil 64 is formed on an end in a radial outward direction of the piston 61 and a gap in the radial direction between the bottom plate 63 and the solenoid coil 64 becomes a projection amount of the piston 61 in a radial inward direction. When the solenoid coil 64 is not energized, the piston 61 is in a state of being pulled in the radial outward direction by a compression coil spring 61*a* one end of which is fixed on the housing 4 side and the other end of which is connected to the piston 61, and projection in the radial inward direction is prevented.

Herein, when the solenoid coil 64 is energized through the connector 44 and a cable 45, the piston 61 being a magnetic body in which force in the radial inward direction is generated by a magnetic field in the bore formed by the solenoid coil 64 projects in the radial inward direction by an amount of the gap. Energization timing of the solenoid coil 64 is when the hole device 41 detects the maximum operation amount position. At that time, as illustrated in FIG. 2(*a*), the convex portion of the holding unit 50 is located so as to be shifted from the radial direction of the piston 61. Then, the piston 61 projects in the radial inward direction to engage with the convex portion and the piston 61 maintains this state, thereby fixing the operation lever 1 at the maximum operation amount position. Meanwhile, as long as the energization of the solenoid coil 64 is continued, the fixing of the operation lever 1 is maintained, and when the energization is released, the operation lever 1 moves in a direction of the neutral position by spring force of the twisted coil spring 30. The energization is released by a controller C when a limit switch 100 attached to a cylinder not illustrated reaches a predetermined position, as illustrated in FIG. 2. Meanwhile, the operator may perform operation to forcedly return the operation lever 1 to the neutral position P0.

Meanwhile, a ball 62 of the bearing steel is provided on a tip end in the radial inward direction of the piston 61. Also, in order to help the ball 62 rotate, a ball 62*a* of the bearing steel is provided between the same and the piston 61 side and the ball 62 is supported at three points by three balls 62*a*. Herein, a corner inclination of the convex portion of the holding unit 50 is adjusted to be set to an inclination angle with which contact with the ball 62 is smooth and the return of the convex portion may be prevented.

Dust-proof and water-proof treatment of the housing 4 is realized by elastic fitting of an O ring 103 between the detecting unit 42 and the housing 4, that of an O ring 104 between the electromagnetic coil unit 60 and the housing 4 and that of a boot 5 between the housing 4 and a projection 105 by formation of the projection 105 provided on a periphery of the guide 20. Also, an accordion-shaped boot 5, which covers the operation lever 1 and the detent mechanism 6 to wrap a portion between the housing 4 and a base of the handgrip 2 is provided between the handgrip 2 and the detent mechanism 6 and the dust-proof and water-proof treatment is applied thereto. Meanwhile, an inside of the housing 4 is immersed in grease.

Herein, a detent function by the electric lever device is described with reference to FIGS. 3 and 4. The electric lever device is provided with a first detent position P1 to instruct the operator of start of drive control of the hydraulic cylinder and the like from the neutral position and a second detent position P2 to instruct the operator that the operation lever 1 is held at the maximum operation amount position P3 in association with the rotation of the operation lever 1.

Figure 3:
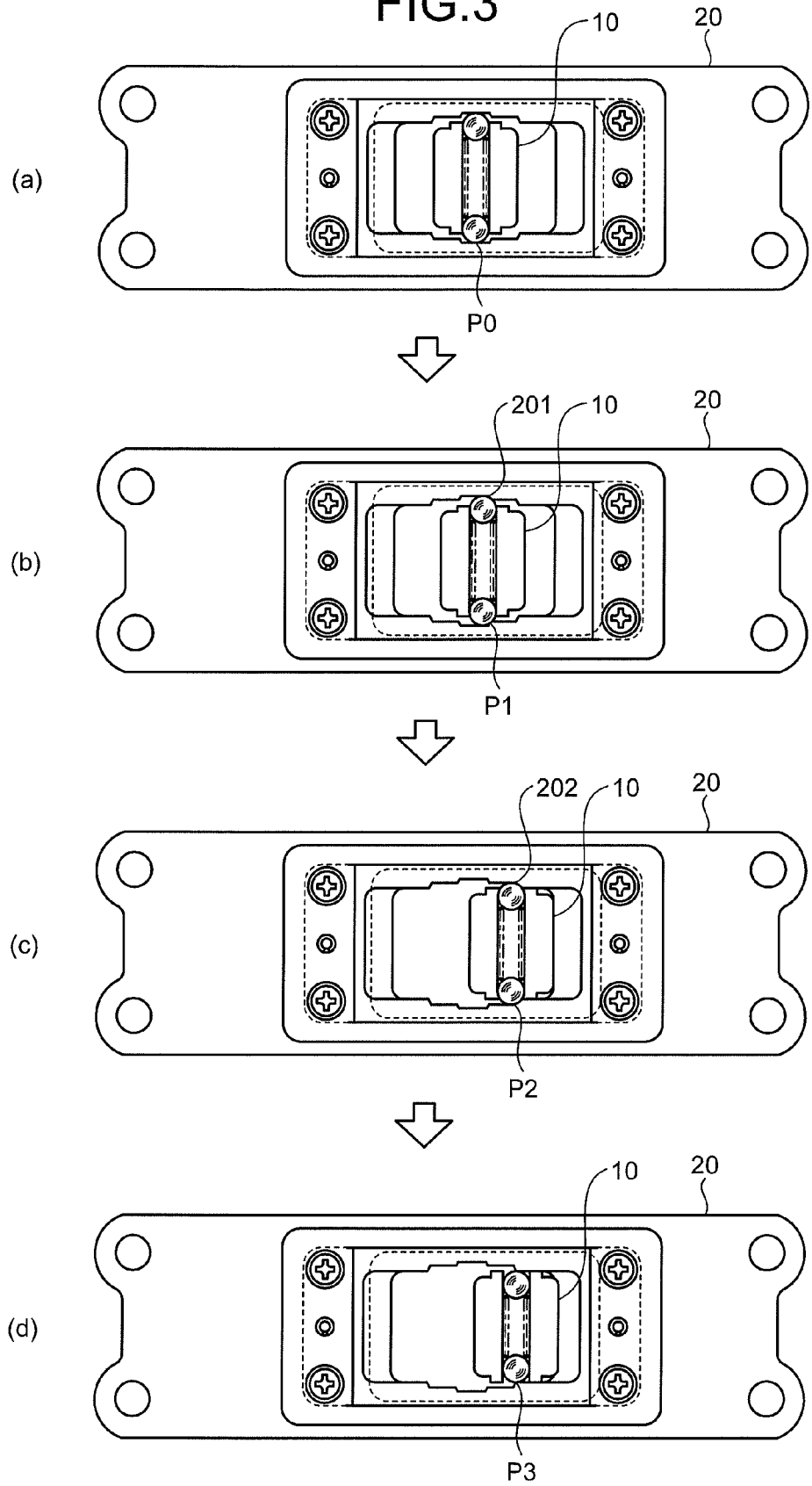
FIG. 3 is a view illustrating operation of a detent mechanism associated with movement of an operation lever.

FIG. 3 illustrates a state of the pressing unit 10 when the operation lever 1 is moved from the neutral position P0 to the maximum operation amount P3 in the circumferential direction FA. When the operation lever 1 moves in the circumferential direction FA from the state in which this is located at the neutral position P0 (FIG. 3(*a*)), as illustrated in FIG. 3(*b*), this reaches the first detent position P1 at which the balls 13*a* and 13*b* are brought into contact with a step 201 of the guide opening 21 and the load of the operation force applied to the operation lever 1 becomes large. By getting over the first detent position P1, the operator may know to enter a drive control region E and safety in operation may be maintained. Thereafter, the operation may drive control the hydraulic cylinder and the like according to the operation amount of the operation lever 1 in the drive control region E.

Further, when the operation lever 1 is moved in the circumferential direction FA, as illustrated in FIG. 3(*c*), this reaches the second detent position P2 at which the balls 13*a* and 13*b* are brought into contact with a step 202 of the guide opening 21 and the load of the operation force applied to the operation lever 1 becomes large. By getting over the second detent position P2, the operator may know that the operation lever 1 is held at the maximum operation amount position P3. Thereafter, the operation lever 1, which gets over the load of the second detent position P2, is held at the maximum operation amount position P3 by the above-described piston 61 and the holding unit 50.

Figure 4:
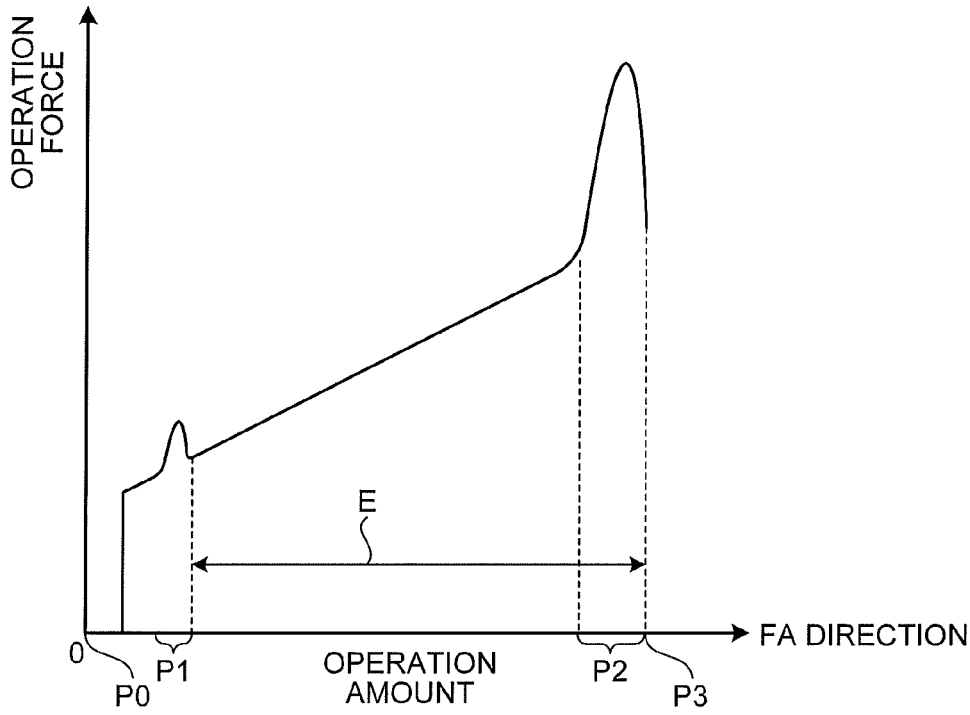
FIG. 4 is a view illustrating relationship between an operation amount of the operation lever and operation force applied to an operator.

Meanwhile, as illustrated in FIG. 4, since the returning force by the above-described twisted coil spring 30 becomes larger with increase in the operation amount (rotation amount), gradually larger operation force is required as the operation amount increases. Also, since the spring force of the twisted coil spring 30 is balanced between the spring holder 33 and the fixing pins 31 and 32, the operation force of the operation lever 1 is set to 0 at the neutral position.

Figure 5:
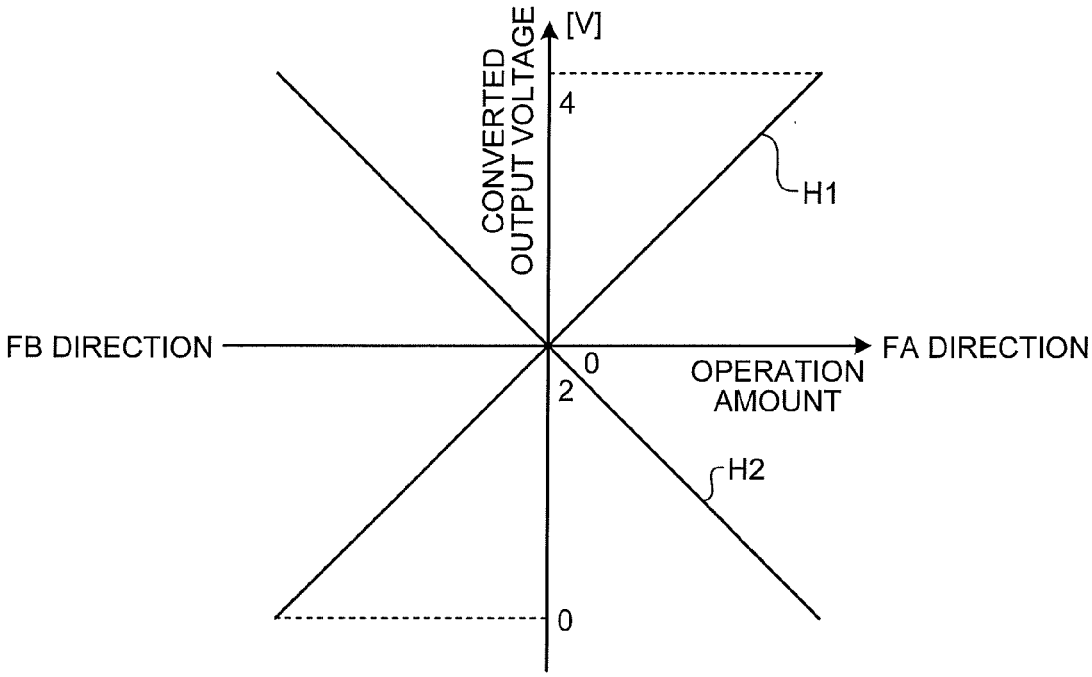
FIG. 5 is a view illustrating relationship between an operation amount by two hole devices and a converted output voltage.

Meanwhile, the two hole devices 41 are provided because one of them is used as an actual measurement hole device and the other is used as an abnormality occurrence detection hole device. That is to say, as illustrated in FIG. 5, a converted output voltage of the electric signal detected by an actual measurement hole device H1 is output so as to be proportional to the operation amount. On the other hand, although an abnormality occurence detection detection hole device H2 is arranged on the same position as the hole device H1 and outputs the same value, an output of each hole device H2 is converted to an inversely proportional value by the controller C as illustrated in FIG. 5. Then, the controller C adds the converted output voltage inversely converted to the converted output voltage output from the hole device H1 and judges that there is no abnormality in the hole device when an added value falls within a predetermined range and controls by using the output from the hole device. On the other hand, when the added value is out of the predetermined range, the controller outputs error supposing that the abnormality occurs in the hole device.

Meanwhile, although the detent function for the operation lever 1 only in the circumferential direction FA is described in the above-described embodiment, the detent function is similarly realized for the operation lever 1 also in the circumferential direction FB. For example, the operation in the circumferential direction FA is in a direction to extend the hydraulic cylinder and the operation in the circumferential direction FB is in a direction to contract the hydraulic cylinder.

Although the through hole 11 is formed on the pressing unit 10 in the above-described embodiment, this is not a limitation, and it is also possible to provide a hole one end of which is blocked in place of the through hole 11, insert the extension coil spring 12 into this hole and provide a ball corresponding to the balls 13*a* and 13*b* on an opening thereof. However, when the through hole 11, the extension coil spring 12, and the balls 13*a* and 13*b* are provided as in the above-described embodiment, twist of each end (balls 13*a* and 13*b*) in the circumferential direction of the operation lever 1 is prevented, so that this is preferable.

Further, although the width in the axis C1 direction of the guide opening 21 is made narrower with the increase in the operation amount in the above-described embodiment, this is not a limitation, and it is also possible that an angle to get over the ball 13 (13*a* and 13*b*) at the detent position may be made larger without changing the width in the axis C1 direction of the guide opening 21.

Since the detent mechanism 6 is provided between the handgrip 2 and the rotational center shaft 3 in this embodiment, movement in the circumferential direction on a larger radial position may be obtained as compared to a case in which the detent mechanism is directly provided on the rotational center shaft 3, and as a result, resolution of the detent position becomes high and the detent position with a high degree of accuracy may be set. Especially, when this is provided on a portion of a so-called handle of the operation lever, a large movement range in the circumferential direction of the operation lever 1 may be obtained and the resolution of the detent position may be improved.

Also, since the detent mechanism 6 is not provided in the vicinity of the rotational center shaft 3 in this embodiment, a great number of detent positions may be set in relation to the above-described resolution and the detent mechanism is not small and complicated, so that a configuration becomes easy and maintenance performance is improved.

Especially, since the detent mechanism may be installed so as to be separated from various functions centralized in the vicinity of the rotational center shaft 3, a degree of freedom of a design may be improved.

Further, change in the detent mechanism is not in the radial direction and the balls 13*a* and 13*b* of the pressing unit 10 extend and contract in the axis C1 direction in this embodiment, so that the device may be prevented from becoming large due to the detent mechanism even when this is on a position away from the rotational center shaft 3.

Also, since the detent mechanism 6 is provided in the operation lever 1 in this embodiment, it is not required to make the width in the axis C1 direction of the electric lever device large for installing the detent mechanism 6, so that downsizing of the electric lever device may be promoted. Especially, it is not required to make the width in the axis C1 direction of the electric lever device large, so that an electric lever device group may be compactly installed even when a plurality of electric lever devices are installed in parallel.

Industrial Applicability

As described above, the electric lever device according to the present invention is useful in the electric lever device including the detent function to apply the load to the operation lever at a desired detent position and instruct the operator of a current operation state or a next operation state, and is especially suitable for the electric lever device used in the construction machine, an industrial machine and the like.

REFERENCE SIGNS LIST

1 operation lever
2 handgrip
3 rotational center shaft
4 housing
4*a* attaching portion
5 boot
6 detent mechanism
10 pressing unit
11 through hole
12 extension coil spring
13*a*, 13*b*, 62, 62*a* ball
20 guide unit
21 guide opening
22 stopper unit
30 twisted coil spring
31, 32 fixing pin
33 spring holder
40 permanent magnet
41 hole device
42 detecting unit
43, 45 cable
44 connector
50 holding unit
60 electromagnetic coil unit
61 piston
61*a* compression coil spring
63 bottom plate
64 solenoid coil
100 limit switch
101, 102 positioning pin
103, 104 O ring
C controller
C1 axis
P1 first detent position
P2 second detent position

The invention claimed is:

1. An electric lever device, comprising:

an operation lever including a handgrip held by an operator on one end and a rotational center shaft of the operation lever formed on the other end;

a detecting unit for detecting a rotation amount of the rotational center shaft; and a holding unit for fixing the operation lever to prevent return, the detecting unit and the holding unit being arranged on a surface perpendicular to an attaching surface of the electric lever device and a surface perpendicular to the rotational center shaft of the operation lever, wherein a detent mechanism is provided between the rotational center shaft and the handgrip, the detent mechanism includes:

a pressing mechanism provided on the operation lever for generating pressing force in an axial direction of the rotational center shaft; and a detent guide mechanism that guides a movement of the operation lever to a circumferential direction of the rotational center shaft, and increasing the pressing force in a stepwise fashion by narrowing a guide width in the axial direction of the rotational center shaft in a stepwise fashion in order to apply a load to the movement of the operation lever.

2. The electric lever device according to claim 1, wherein the pressing mechanism includes:

a hole formed in the axial direction of the rotational center shaft of the operation lever;

an extension member extended by changing the pressing force in the axial direction of the rotational center shaft arranged in the hole; and a ball provided on an end of the extension member and is capable of moving in and out of the hole to be brought into contact with the detent guide mechanism.

3. The electric lever device according to claim 2, wherein the hole is a through hole, and the ball includes a second ball and one ball is provided on each end of the extension member.

4. The electric lever device according to claim 1, wherein the detent mechanism sequentially enlarges a load applied to the operation lever at a desired detent position in the middle of the movement of the operation lever from a neutral state to a maximum operation amount state.

5. The electric lever device according to claim 1, wherein the detent mechanism applies the load to the operation lever before transition from the neutral state to a variable control state of the operation lever and applies the load to the operation lever before transition from the variable control state to the maximum operation amount state of the operation lever.

6. The electric lever device according to claim 1, wherein the detent mechanism is provided in the vicinity of the attaching surface of the electric lever device.

7. The electric lever device according to claim 1, wherein the holding unit includes an electromagnetic coil unit for holding a position of the operation lever at the maximum operation amount state by electromagnetic force.

* * * * *